US006518863B2

(12) United States Patent
Kawahara et al.

(10) Patent No.: US 6,518,863 B2
(45) Date of Patent: Feb. 11, 2003

(54) DIELECTRIC LAMINATED DEVICE AND MANUFACTURING METHOD THEREOF

(75) Inventors: Emiko Kawahara, Sakai (JP); Toru Yamada, Katano (JP); Hiroshi Kagata, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/862,611

(22) Filed: May 23, 2001

(65) Prior Publication Data

US 2001/0045876 A1 Nov. 29, 2001

(30) Foreign Application Priority Data

May 25, 2000 (JP) ..... 2000-154495

(51) Int. Cl.[7] ..... H01P 1/203
(52) U.S. Cl. ..... 333/204; 333/134; 333/219
(58) Field of Search ..... 333/204, 219, 333/238, 202, 203, 205, 134

(56) References Cited

U.S. PATENT DOCUMENTS 5,479,141 A * 12/1995 Ishizaki et al. ..... 333/204
5,825,264 A * 10/1998 Yamazaki et al. ..... 333/204
5,834,995 A * 11/1998 Richards et al. ..... 333/238
5,926,466 A * 7/1999 Ishida et al. ..... 370/280
5,963,115 A * 10/1999 Holleboom et al. ..... 333/204
6,043,556 A * 3/2000 Tomie ..... 257/664
6,346,866 B2 * 2/2002 Nakakubo et al. ..... 333/204

FOREIGN PATENT DOCUMENTS

JP 6-310919 11/1994
JP 2000-286617 10/2000

* cited by examiner

*Primary Examiner*—Robert Pascal
*Assistant Examiner*—Dean Takaoka
(74) *Attorney, Agent, or Firm*—Smith, Gambrell & Russell, LLP

(57) ABSTRACT

A dielectric laminated device, has a layered product including a plurality of dielectric layers; and a plurality of strip line conductors arranged in the interior of the layered product, wherein the thickness of at least part of the side part of at least one strip line conductor among the plurality of strip line conductors is thicker than that of the central part.

11 Claims, 12 Drawing Sheets

QUARTER WAVELENGTH RESONATOR
CURRENT DISTRIBUTION

DIELECTRIC LAMINATED DEVICE AND MANUFACTURING METHOD THEREOF

BACKGROUND OF THE INVENTION

1. Field of the Invention

The present invention relates to a dielectric laminated device that is mainly used for high frequency radio equipment or the like such as a portable telephone.

2. Description of the Prior Art

Recently, as the communication equipment becomes miniaturized, the dielectric laminated device that is advantageous for the miniaturization is often used as a high frequency device. One example of the above described conventional dielectric laminated device will be described below while referring to the drawings.

FIG. 4 is a drawing showing an exploded illustration of a strip line conductor of a conventional dielectric laminated device that is formed by normal screen printing. In FIG. 4, reference numerals 101*a*, 101*b*, 101*c*, 101*d*, 101*e* denote dielectric layers, and reference numerals 102*a*, 102*b* denote shield conductors, and reference numerals 403*a*, 403*b*, 104*a*, 104*b*, 104*c* denote strip line conductors, and reference numerals 105*a*, 105*b*, 106*a*, 106*b*, 106*c*, 106*d*, 106*e*, 106*f* denote external conductors.

In the interior of the layered product composed of dielectric layers 101*a* to 101*e*, the shield conductor 102*a*, the strip line conductors 403*a*, 403*b*, the strip line conductors 104*a*, 104*b*, 104*c*, and the shield conductor 102*b* are arranged between the dielectric layers in turn, and furthermore, the external conductors 106*a*, 106*b*, 106*c*, 106*e*, and 106*f* in front and on the left and right sides of the layered product connect the shield conductors 102*a*, 102*b* and form the ground terminal, and the external conductor 106*d* on the rear of the layered product connects the common short-circuit ends of the shield conductors 102*a*, 102*b* and the strip line conductors 403*a*, 403*b*, and becomes the ground terminal, the external conductors 105*a*, 105*b* on the left and right sides of the layered product are connected to the strip line conductors 104*a*, 104*b*, respectively, and form the input and output terminals.

As for the dielectric laminated device composed as mentioned above, the function thereof will be described below.

The strip line conductors 403*a*, 403*b* compose a resonator of the quarter wavelength short-circuit type, and the strip line conductor 104*c* forms a capacitor by being arranged facing to part of the above described strip line conductors 403*a*, 403*b*, and connects the above described resonator of the quarter wavelength short-circuit type, and the strip line conductors 104*a*, 104*b* form a capacitor by being arranged facing to part of the above described strip line conductors 403*a*, 403*b*, respectively, and function as the input and output terminals by connecting one of the above described strip line conductors 104*a*, 104*b* and the external conductors 105*a*, 105*b*, respectively. Accordingly, the dielectric laminated device in FIG. 4 functions as a band-pass filter in which the external conductors 105*a*, 105*b* are the input and output terminals.

BRIEF SUMMARY OF THE INVENTION

Object of the Invention

However, in such a construction as mentioned above, the edge angle of a side part of the strip line conductor becomes small, and the conductor loss because of the concentration of electric field to the side pointed part becomes large, and therefore, the loss as the filter characteristics also becomes large. "Edge angle becomes small" in the above description will be described by using FIG. 5.

FIG. 5 is one end face view when the conventional dielectric laminated device shown in FIG. 4 is cut by a plane substantially at right angles to the strip line conductors 403*a*, 403*b* that have substantially parallel relation. As shown in FIG. 5, the angle of the edge part 1403 of the strip line conductors 403*a*, 403*b* is small, and therefore, the concentration of electric field to that edge part 1403 is caused.

When the total of the strip line conductors 403*a*, 403*b* is made uniformly thick, and the angle of the edge part is made large in order to solve this problem, the stress applied to the interior of the laminated device at the time of dropping the temperature in the burning process or at the time of solder re-flow or the like becomes large by the difference in the heat expansion ratio between the metal to be the conductor and the dielectric layer. By this increased stress, a crack is caused in the laminated device, and as a result of that, there has been such a problem that the degradation of electric characteristics or the lowering of mechanical strength is caused.

Furthermore, there has been a deviation in the distribution of the current flowing in the strip line conductor 403. That deviation in the distribution of the current will be described by using FIG. 10. FIG. 10 is a figure showing the distribution of the current flowing in the strip line conductor 403*a* in FIG. 4 that composes the resonator of the quarter wavelength. As shown in FIG. 10, it is apparent that the distribution of the current is large on the short-circuit end side, and small on the open end side. By the way, the thickness of the conventional strip line conductor 403*a* has substantially been uniform, and therefore, in the strip line conductor 403*a*, the conductor loss on the short-circuit end side where current is concentrated is bigger than the conductor loss on the open end side. That is, it was equivalent to the resistance the short-circuit end side where current is concentrated is bigger than the resistance on the open end side. Therefore, there has been such a problem that the loss as the filter characteristics is also large. This problem has also been caused similarly in the strip line conductor 403*b*.

Furthermore, a similar problem has also been caused in the strip line conductor composing the resonator of the half wavelength. In FIG. 11, the distribution of the current flowing in the strip line conductor composing the resonator of the half wavelength is shown. As shown in FIG. 11, it is apparent that a part where a lot of current flows exists in the central part in the case of the strip line conductor composing the resonator of the half wavelength. The thickness of the conventional strip line conductor has been substantially uniform, and therefore, in the strip line conductor composing the resonator of the half wavelength, the resistance value on the short-circuit end side at the central part has been larger than the resistance value on the open end side, and therefore, there has been such a problem that the loss as the filter characteristics is also large.

The present invention is achieved due to the above described problems, and it is an object thereof to provide a dielectric laminated device in which it is difficult to cause the concentration of electric field to be the source of the increase of the loss of the conductor.

Furthermore, it is an object of the present invention to provide a dielectric laminated device in which the resistance of the strip line conductor is more leveled than that of the prior art.

The 1st embodiment of the present invention is a dielectric laminated device, comprising:

a layered product including a plurality of dielectric layers; and a plurality of strip line conductors arranged in the interior of the layered product, wherein the thickness of at least part of the side part of at least one strip line conductor among said plurality of strip line conductors is thicker than that of the central part.

The 2nd embodiment of the present invention is the dielectric laminated device according to 1st embodiment, wherein said at least one strip line conductor forms a resonator of the quarter wavelength where the end is a short-circuit, and the thickness of the side part on the short-circuit end side of the resonator is thicker than that of the central part.

The 3rd embodiment of the present invention is the dielectric laminated device according to 1st embodiment, wherein said at least one strip line conductor forms a resonator of the half wavelength where the end is an open, and the thickness of the side part at a part substantially separated from the open end by quarter wavelength in the wavelength direction of the resonator is thicker than that of the central part.

The 4th embodiment of the present invention is a manufacturing method of a dielectric laminated device, having a layered product including a plurality of dielectric layers; and a plurality of strip line conductors arranged in the interior of the layered product, said method comprising:

a step of forming a strip line conductor in which the thickness of at least one side part is thicker than that of the central part on a specified dielectric layer material, and a step of pressing and laminating another dielectric layer material thereon.

The 5th embodiment of the present invention is a dielectric laminated device, comprising:

a layered product including a plurality of dielectric layers; and a plurality of strip line conductors arranged in the interior of the layered product, wherein the thickness of a part having more electric current concentrated is thicker than that of a part having less electric current concentrated, in at least one strip line conductor among said plurality of strip line conductors, The 6th embodiment of the present invention is the dielectric laminated device according to 5th embodiment, wherein said at least one strip line conductor forms a resonator of the quarter wavelength where the end is a short-circuit, and the thickness on the short-circuit end side of the resonator is thicker than that on the open end side.

The 7th embodiment of the present invention is the dielectric laminated device according to 5th embodiment, wherein said at least one strip line conductor forms a resonator of the half wavelength where the end is an open, and the thickness of a part substantially separated from the open end of the resonator by quarter wavelength is thicker than that of the open end part.

The 8th embodiment of the present invention is a manufacturing method of a dielectric laminated device, having a layered product including a plurality of dielectric layers; and a plurality of strip line conductors arranged in the interior of the layered product, said method comprising:

a step of forming a strip line conductor in which the thickness of a part having more electric current concentrated is thicker than that of a part having less electric current concentrated on a specified dielectric layer material, and a step of pressing and laminating another dielectric layer material thereon.

The 9th embodiment of the present invention is the dielectric layered device according to any one of 1st, 2nd, 3rd, 5th, 6th, 7th embodiments, wherein an inside material and an outside material are different at a part in which the thickness of said strip line conductor is relatively thick.

The 10th embodiment of the present invention is the dielectric laminated device according to 1st embodiment, wherein a plurality of shield conductors are arranged in the interior of said layered product, and at least two resonators of the quarter wavelength where the end is a short-circuit and a strip line conductor facing to part of said resonators of the quarter wavelength where the end is a short-circuit are arranged between said plurality of shield conductors, and the strip line conductor connects said two resonators of the quarter wavelength where the end is a short-circuit to each other and forms a multi-stage filter, and the thickness of part of said resonators of the quarter wavelength where the end is a short-circuit is thicker than that of the other part.

The 11th embodiment of the present invention is Communication equipment, comprising:

a transmitter; and a receiver, wherein the dielectric laminated device according to any one of 1st, 2nd, 3rd, 5th, 6th, 7th, 10th embodiments is included as an element.

DESCRIPTION OF SYMBOLS

Figure 1:
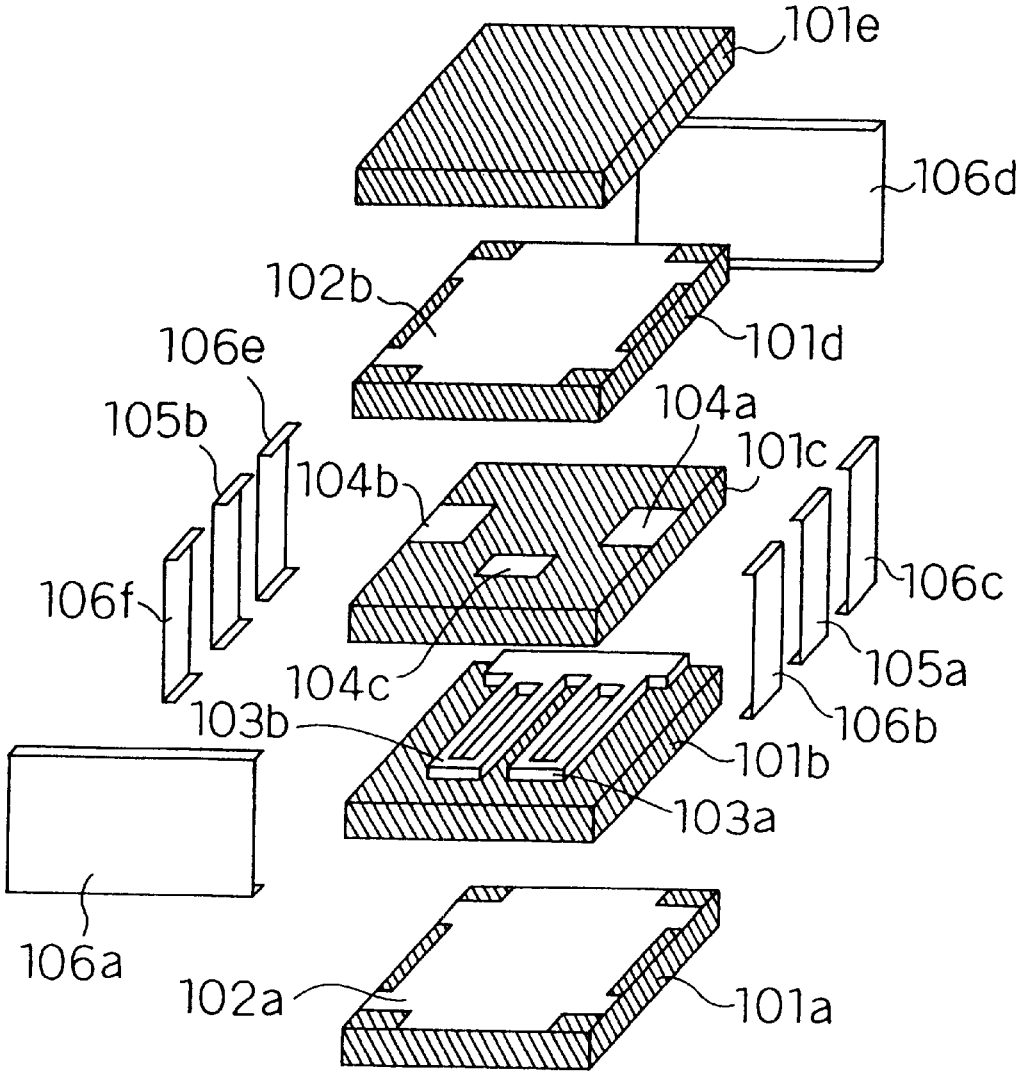
FIG. 1 is an exploded illustration of a dielectric laminated device in a first embodiment of the present invention.

100 layered product
101 dielectric layer
102 shield conductor

103, 104, 303, 403, 703 strip line conductor
105, 106 external conductor
1103 side part
1104 central part
1105 conductor on surface of strip line conductor 103
1106 interior of strip line conductor 103

DETAILED DESCRIPTION OF THE PREFERRED EMBODIMENTS

The preferred embodiments of the present invention will be described below by referring to the drawings.

(First Embodiment)

The dielectric laminated device of a first embodiment of the present invention will be described while referring to the drawings.

FIG. 1 is a drawing showing an exploded illustration of the dielectric laminated device in the first embodiment of the present invention. In FIG. 1, reference numeral 101 denotes the dielectric layer, and reference numeral 102 denotes the shield conductor, and reference numerals 103, 104 denote the strip line conductors, and reference numerals 105, 106 denote the external conductors.

Here, the laminated structure of the dielectric laminated device of this first embodiment will be described. On the upside of the first dielectric layer 101*a*, the first shield conductor 102*a* is arranged, and on the upper side of that conductor 102*a*, the second dielectric layer 101*b* is laminated, and on the upside of that dielectric layer 101*b*, two strip line conductors 103*a*, 103*b* are arranged.

Furthermore, on the upper side of those conductors 103, the third dielectric layer 101*c* is laminated, and on the upside of that dielectric layer 101*c*, three strip line conductors 104*a*, 104*b*, 104*c* are arranged. Furthermore, on the upper side of those conductors 104, the fourth dielectric layer 101*d* is laminated, and on the upside of that dielectric layer 101*d*, the second shield conductor 102*b* is arranged, and on the upper side of that conductor 102*b*, the fifth dielectric layer 101*e* is laminated. Thus, the laminated structure of the dielectric laminated device is formed.

Furthermore, in front of the layered product composed of the dielectric layers 101*a* to 101*e*, the external conductor 106*a* is provided, and on the side of the layered conductor, the external conductors 105*a*, 105*b*, 106*b*, 106*c*, 106*d*, 106*e* are provided, and furthermore, on the rear of the layered product, the external conductor 106*d* is provided. The connecting relation between these external conductors and the electrode formed on each dielectric layer will be described next.

The first shield conductor 102*a*, the short-circuit end on the rear side of the layered product to which both the strip line conductors 103*a*, 103*b* are connected together, and the second shield conductor 102*b* are connected by the external conductor 106*d* and are grounded. Furthermore, the strip line conductor 104*a* and the external conductor 105*a* are connected, and the strip line conductor 104*b* and the external conductor 105*b* are connected. Furthermore, the first shield conductor 102*a* and the second shield conductor 102*b* are connected by the external conductors 106*a*, 106*b*, 106*c*, 106*e*, and 106*f* and are grounded, and furthermore, the external conductors 106*b*, 106*f* are connected to the external conductor 106*a*, and the external conductors 106*c*, 106*e* are connected to the external conductor 106*d*.

Figure 2A:
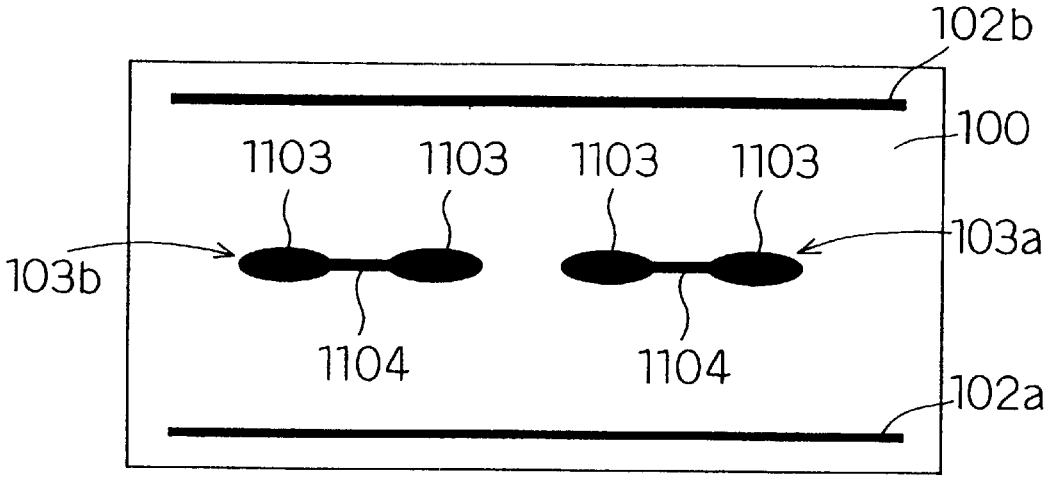
FIG. 2 is a cross sectional view of an electrode of the dielectric laminated device in the first embodiment of the present invention.

By the way, as shown in FIG. 1 and FIG. 2A, in the above described strip line conductors 103*a* and 103*b*, the thickness of the side part 1103 thereof is formed to be tens of times the skin depth of the micro wave band. For example, if the strip line conductors 103*a* and 103*b* are composed of silver, the skin depth at 2 GHz band is about 1.5 $\mu$m, and the thickness of the above described side part 1103 is formed to be 30 $\mu$m or more. Furthermore, FIG. 2A is one end face view when the dielectric laminated device of the first embodiment in FIG. 1 is cut by a plane substantially at right angles to the strip line conductors 103*a*, 103*b* that have substantially parallel relation.

Figure 2:
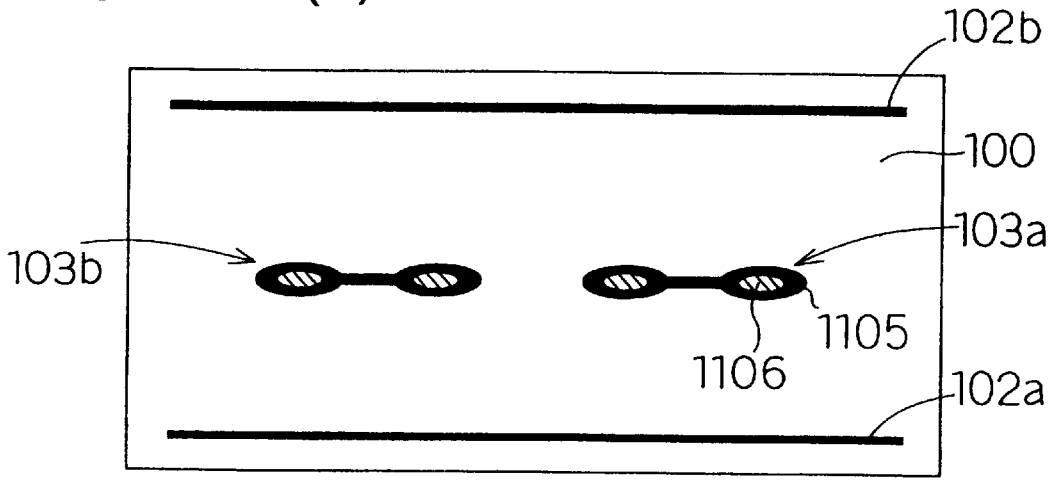

As for the dielectric laminated device of the first embodiment composed as mentioned above, the function thereof will be described below by using FIG. 1 and FIG. 2.

The strip line conductors 103*a*, 103*b* are grounded through the external conductor 106*d*, and form a resonator of the quarter wavelength where the end is a short-circuit, and the strip line conductor 104*c* forms a capacitor by being arranged facing to part of the above described strip line conductors 103*a*, 103*b* respectively, and it functions as an inter-section coupling capacitance.

Furthermore, the strip line conductor 104*a* is arranged facing to part of the strip line conductor 103*a*, and the strip line conductor 104*b* is arranged facing to part of the strip line conductor 103*b*, and each forms a capacitor, and the strip line conductor 104*a* is connected to the external conductor 105*a*, and the strip line conductor 104*b* is connected to the external conductor 105*b*, and they form the input and output terminals. Accordingly, the dielectric laminated device in FIG. 1 functions as a band pass filter in which the external conductors 105*a*, 105*b* are the input and output terminals.

Figure 5:
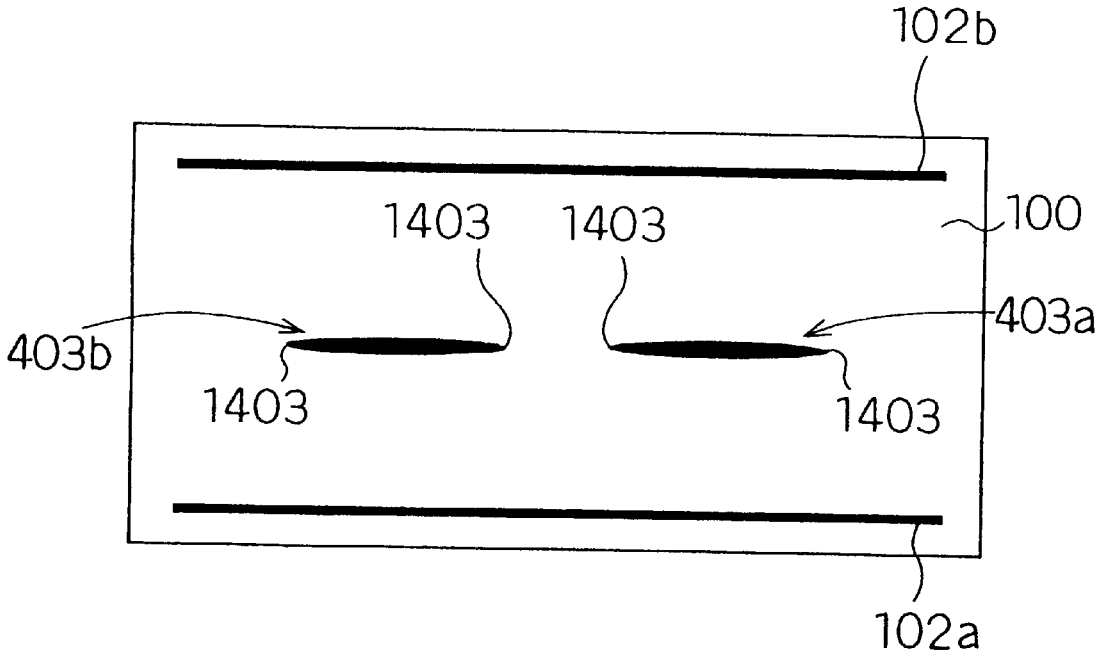
Fig. 5 PRIOR ART
FIG. 5 is a cross sectional view of the electrode of the conventional dielectric laminated device.

Furthermore, as mentioned above, FIG. 2A is a drawing showing an end face view of the electrode of the dielectric laminated device shown in FIG. 1, and it has a side part 1103 with an edge angle larger than that of the side pointed part 1403 (refer to FIG. 5) of the conventional strip line conductor, and the conductor loss because of the concentration of electric field to the side part 1103 of the strip line conductor is restrained.

Furthermore, in order to make the thickness of the side part 1103 of the strip line conductors 103*a* and 103*b* thicker than that of the central part 1104, as shown in FIG. 1, the strip line conductors 103*a*, 103*b* in which the thickness of the side part is thicker than that of the central part have been formed in advance on the dielectric layer 101*b* before laminating the dielectric layers 101*a* to 101*e*.

If doing so, the thickness of the strip line conductors 103*a*, 103*b* are not uniformly thick, and therefore, at the time of burning the layered product 100 made by laminating the dielectric layers 101*a* to 101*e*, the stress because of the difference in heat contraction can be restrained to the minimum, and generating of a crack is restrained. One end face of the strip line conductors 103*a*, 103*b* of the layered product 100 after the burning can be shown in FIG. 2A.

Next, the manufacturing method of the dielectric laminated device of the present invention will be described. The forming method of each conductor uses a method by the normal screen printing, and the laminating of the dielectric green sheet and the printing of the conductor pattern are performed in turn, and after the integration by the press crimping and the burning, the external conductor is printed and baked. Furthermore, the strip line conductor 103 is formed such that the pattern of the strip line conductor is printed on the upside of the dielectric green sheet 101*b* and dried, and after that, the pattern of only the side part of the strip line conductor is overlapped and printed to the above described strip line conductor. According to the above described method, the strip line conductor having such a cross sectional form as shown in FIG. 2 can be obtained.

Furthermore, in the case where each conductor pattern is laminated and press-crimped to be unified in turn after each has been printed and formed on the dielectric green sheet, the strip line conductor having a similar cross sectional form can also be obtained.

As mentioned above, according to the present embodiment, the conductor loss of the strip line conductor can be decreased by increasing the edge angle of the side part 1103 of the strip line conductor, and if the above described strip line conductor is used as a resonator, the loss as the filter characteristics can also be improved. Furthermore, only the side part 1103 is thick, and therefore, it is possible to restrain the occurrence of a crack because of the difference in the heat expansion ratio between the dielectric and the conductor.

Furthermore, the similar effect can also be obtained in the case where as shown in FIG. 2B, the interior 1106 of the strip line conductor 103 is made of a material different from that of the conductor 1105 of the surface in the side part 1103 shown in FIG. 2A. The material of the interior 1106 of the strip line conductor is not specifically limited as long as it is a material different from that of the conductor 1105 of the surface, but it is preferably be, for example, a material having a conductivity lower than that of the above described conductor 1105, a material having a heat expansion ratio equal to that of the above described dielectric, or a material having the middle heat expansion ratio between the heat expansion ratio of the above described dielectric and the heat expansion ratio of the above described conductor.

Consequently, the stress because of the difference in the heat contraction of the thickened part of the strip line conductor can furthermore be decreased, and it is possible to restrain the lowering of the mechanical strength because of the internal crack and the degradation of the electric characteristics.

Figure 7:
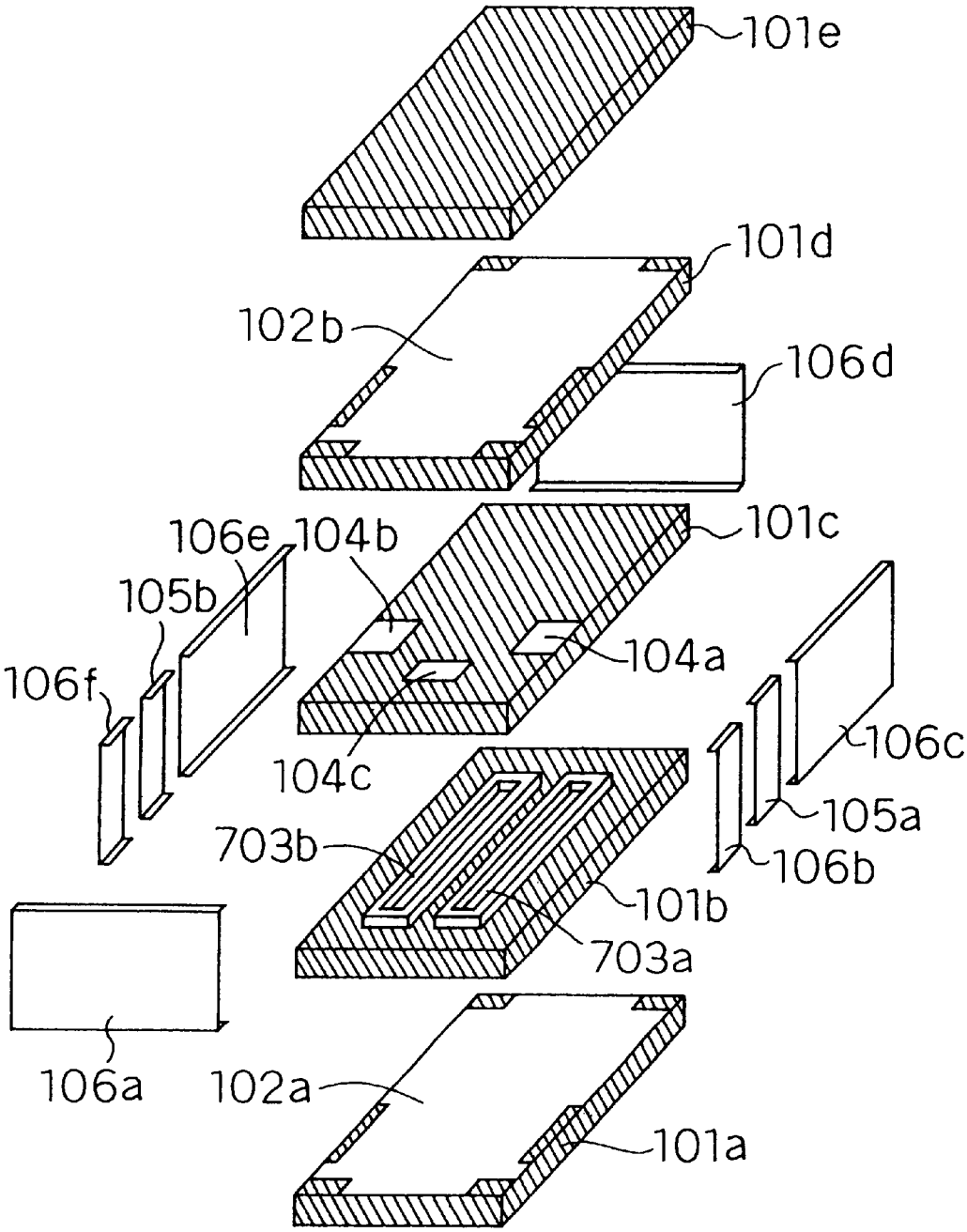
FIG. 7 is an exploded illustration of the dielectric laminated device in the first embodiment of the present invention.

Furthermore, the similar effect can also be obtained even in the case where the above described resonator 103 of the quarter wavelength where the end is a short-circuit is a resonator of the half wavelength where the end is an open circuit like the strip line conductor 703 in FIG. 7.

(Second Embodiment)

The dielectric laminated device of a second embodiment of the present invention will be described below while referring to the drawings.

Figure 3:
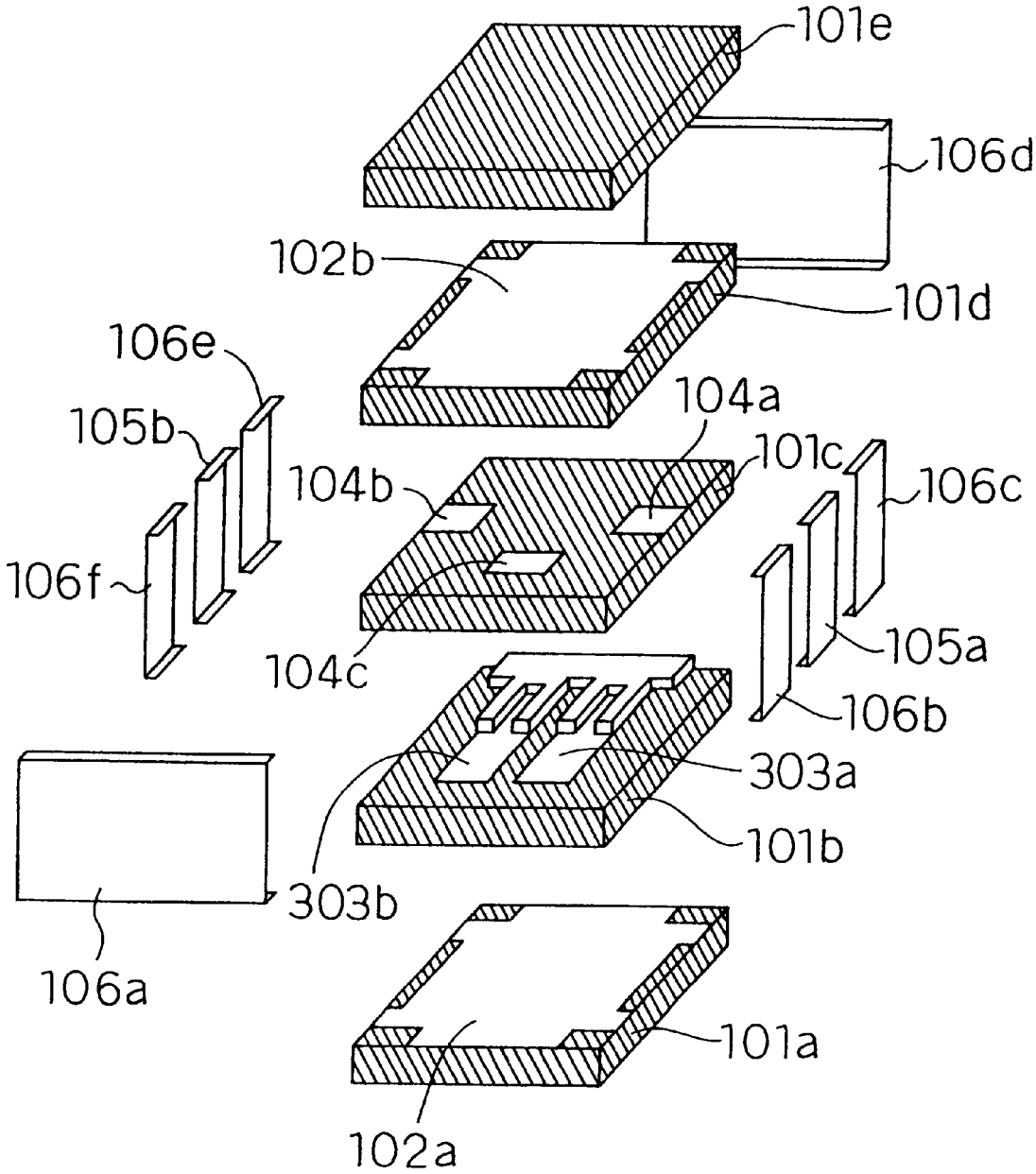
FIG. 3 is an exploded illustration of the dielectric laminated device in a second embodiment of the present invention.
Figure 4:
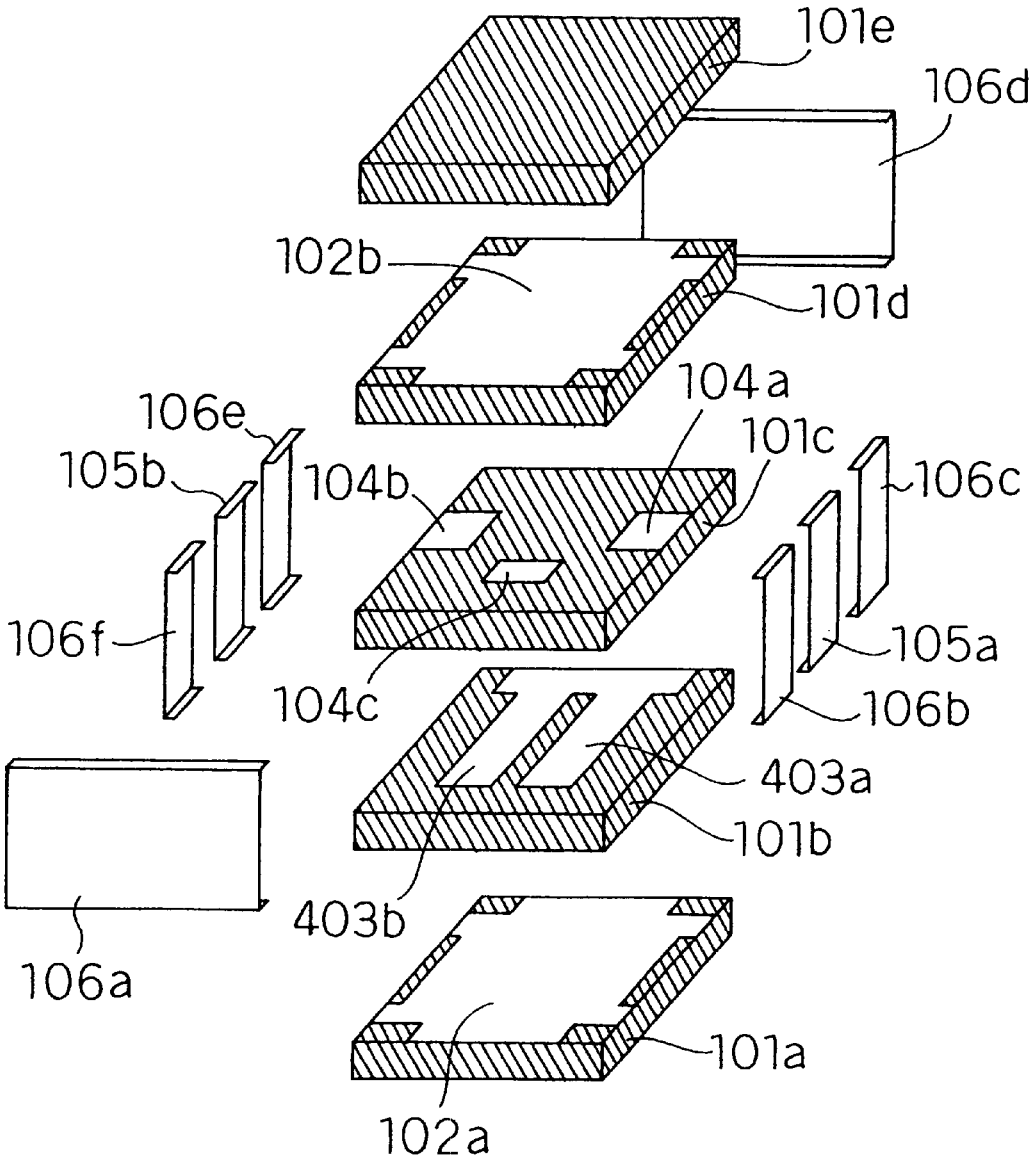
Fig. 4 PRIOR ART
FIG. 4 is an exploded illustration of the conventional dielectric laminated device.
Figure 6:
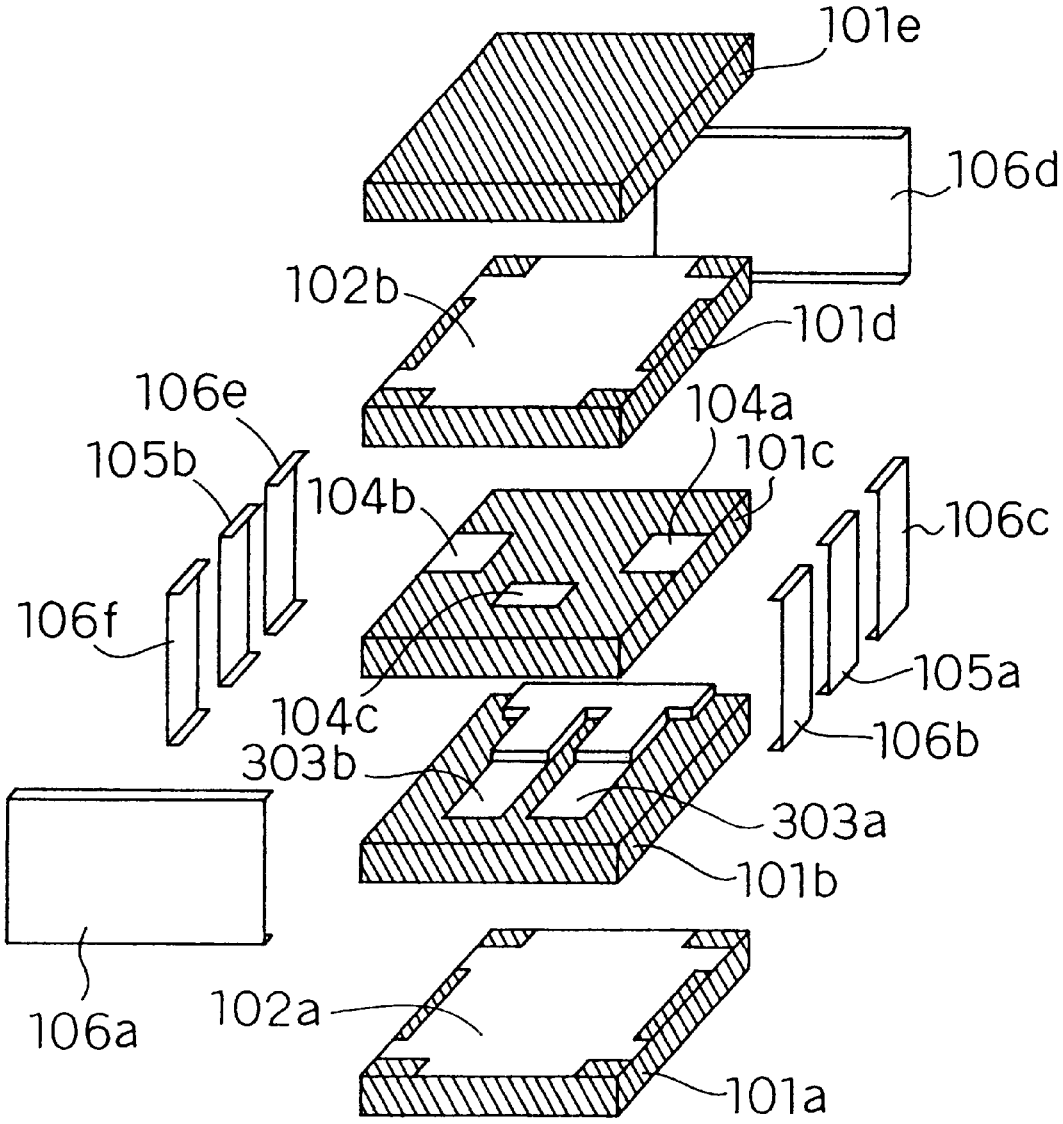
FIG. 6 is an exploded illustration of the dielectric laminated device in the second embodiment of the present invention.

FIG. 3 and FIG. 6 are exploded illustrations of the dielectric laminated device of the second embodiment of the present invention. The laminated structure and the function are similar to those of the first embodiment, and the same numerals are given to the corresponding elements. It is different from that of the first embodiment in that the strip line conductor 303 has a part thicker than the other part provided near the connecting part with the external conductor.

As mentioned above, according to the present embodiment, in the resonator of the quarter wavelength where the end is a short-circuit, the current is concentrated at a position near the short-circuit end, and especially at the side part thereof, and therefore, the resistance near the short-circuit end can be made smaller than that of the prior art in such a way that the total is not made thick and only the part near the short-circuit end where the current is concentrated is made thick. That is, in the resonator of the quarter wavelength where the end is an open circuit, the resistance value can also be leveled, and consequently, the conductor loss can be restrained.

Furthermore, by increasing the thickness of the short-circuit end of the strip line conductor, the contact resistance with the external conductor can be decreased, and if the above described strip line conductor is used as a resonator, the loss as the filter characteristics can also be improved.

Furthermore, the strip line conductor near the open end is thin, and therefore, if the strip line conductors 104 are arranged facing at this part, the swell of the strip line conductor is small, and it is possible to stably form the inter-section coupling capacitance and the input and output capacitance, and there is also an effect in improving the yield rate.

Furthermore, the similar effect can be obtained, not only in the case of the design of the inter-section coupling capacitance and the input and output capacitance but also in all cases of forming the capacitor, by arranging part of the resonator such as the loading capacitance and part of the strip line conductor facing to each other.

Figure 8:
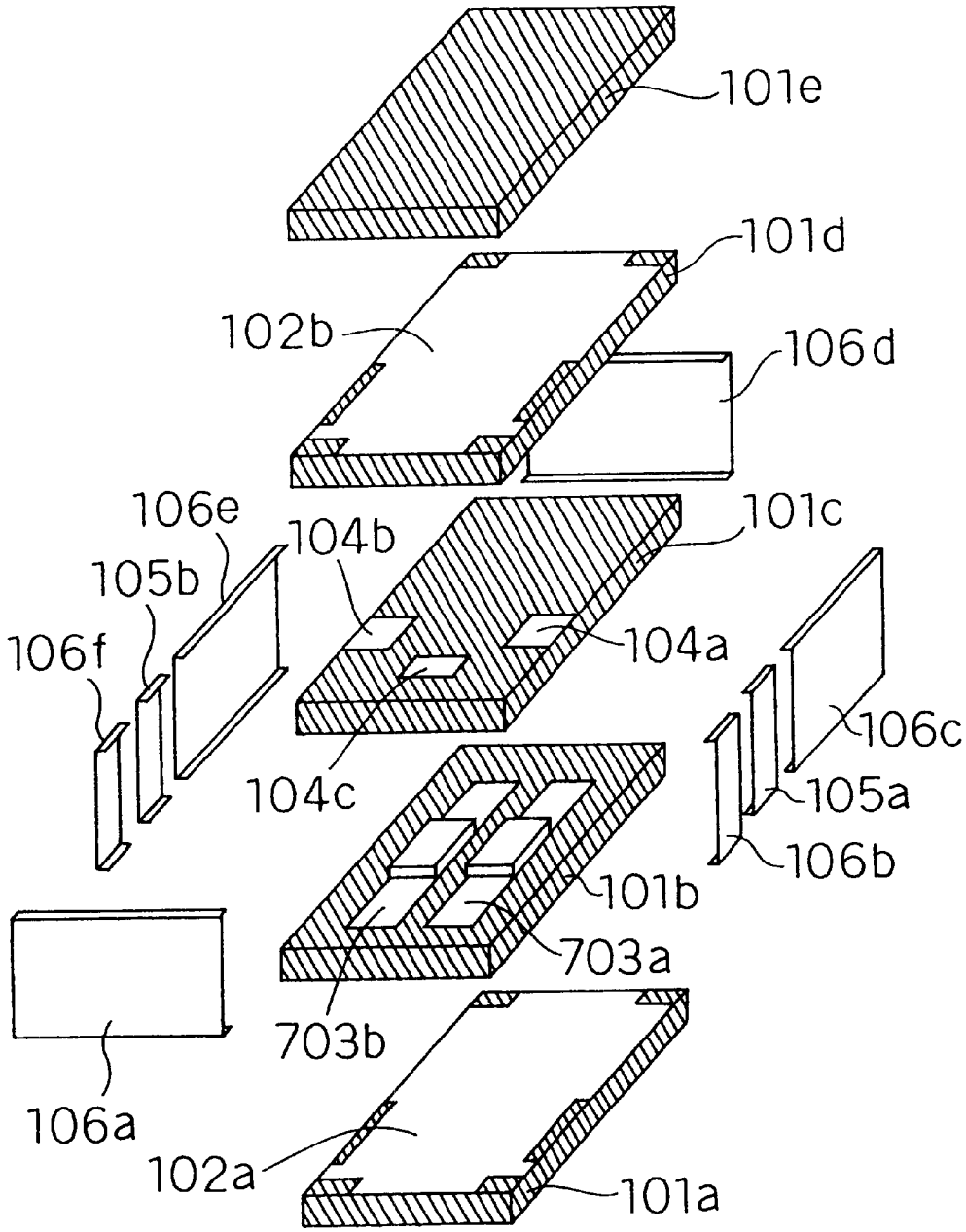
FIG. 8 is an exploded illustration of the dielectric laminated device in the second embodiment of the present invention.
Figure 9:
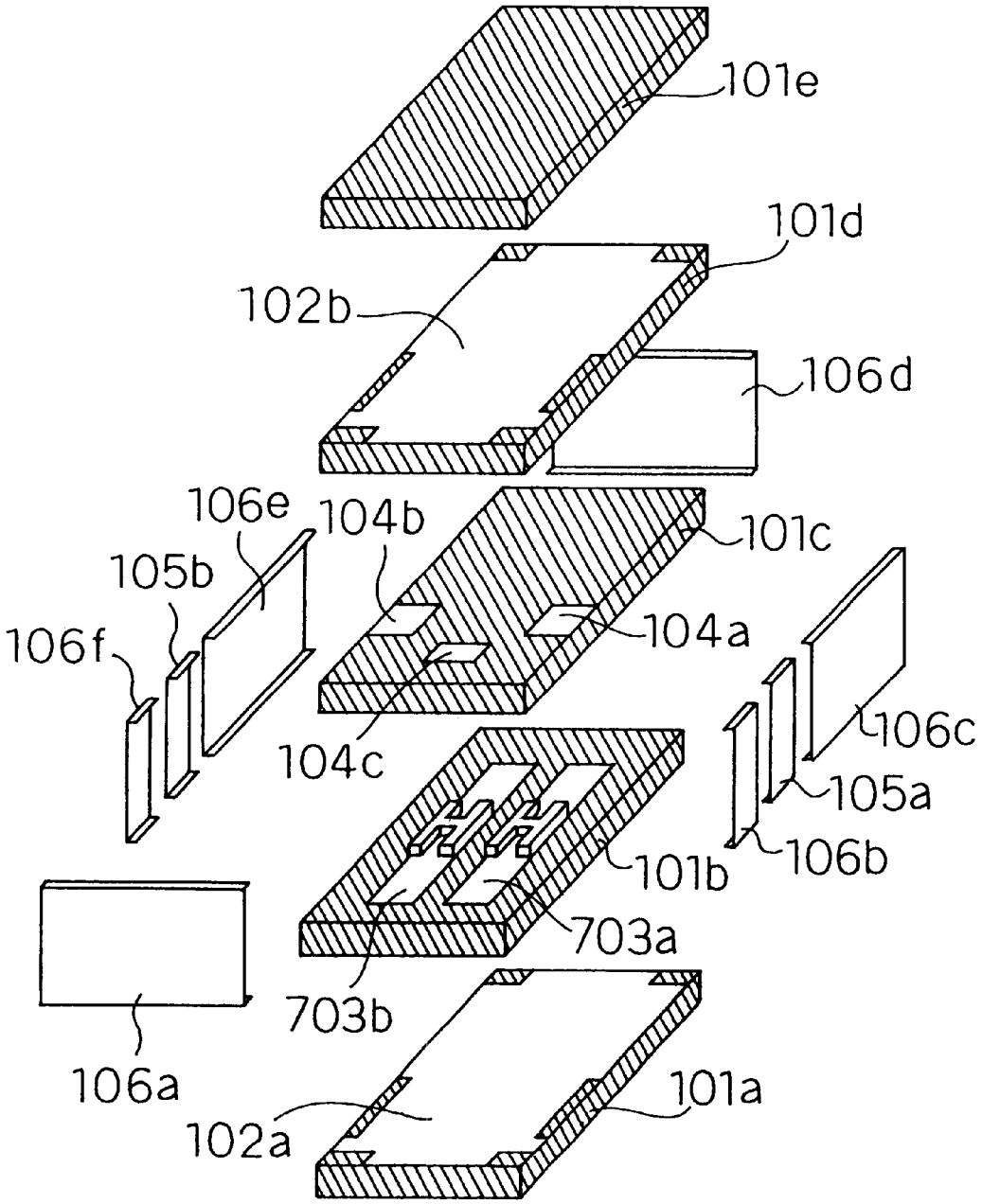
FIG. 9 is an exploded illustration of the dielectric laminated device in the second embodiment of the present invention.
Figure 10:
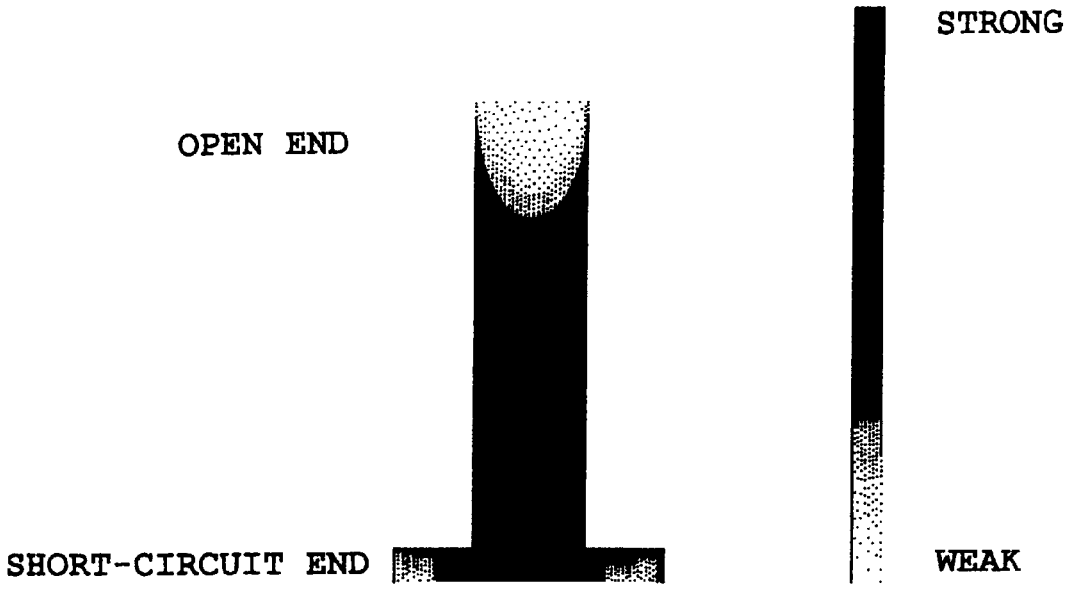
FIG. 10 is a view showing the distribution of the current flowing in a strip line conductor composing a resonator of the quarter wavelength.
Figure 11:
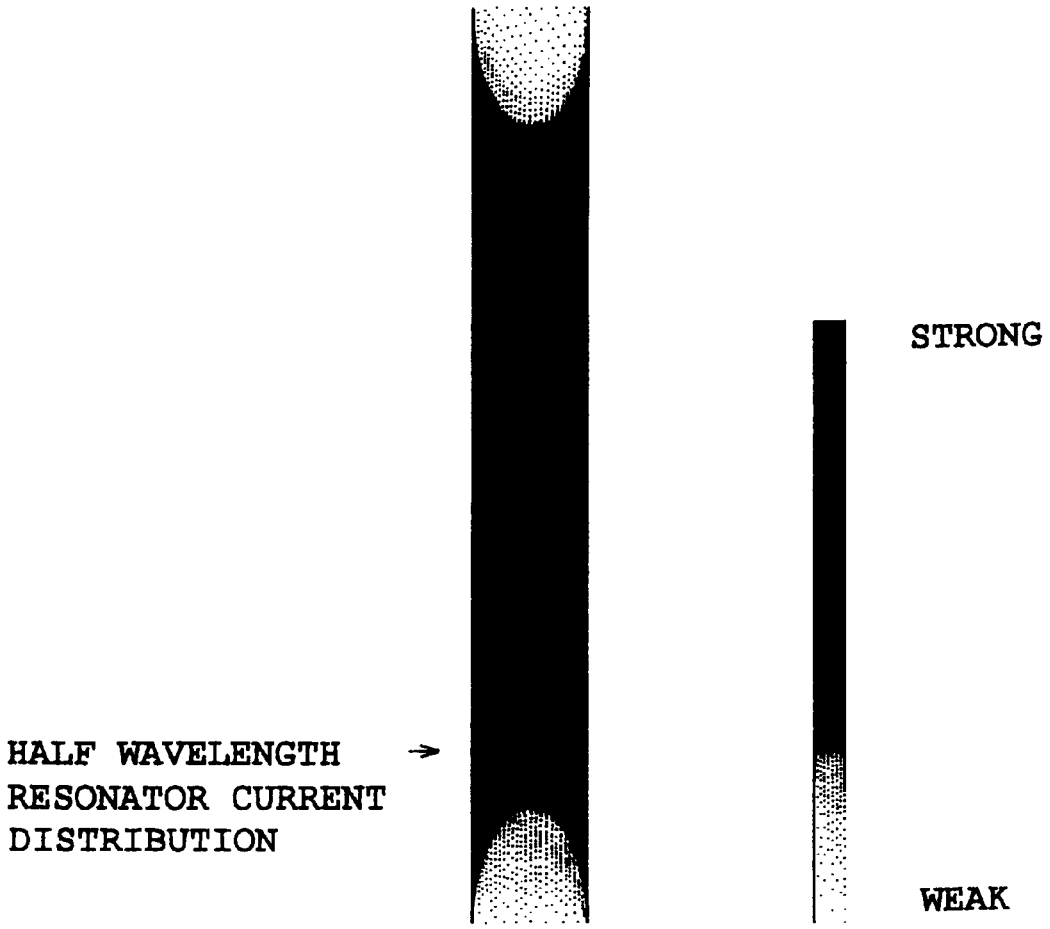
FIG. 11 is a view showing the distribution of the current flowing in the strip line conductor composing the resonator of the half wavelength.

Furthermore, in the case of the resonator of the half wavelength where the end is an open circuit, the resistance at the part where the current is concentrated can also be made smaller than that of the prior art, by making a part (703 in FIG. 8) near the part separated by quarter wavelength from the open end where the current is concentrated, or the side part thereof (703 in FIG. 9) thick. That is, in the case of the resonator of the half wavelength where the end is an open circuit, the resistance value can also be leveled.

Furthermore, in each of the above described embodiments, the description has been given as for the case of the two stage band pass filter, but the similar effect can also be obtained in the case of various kinds of filters such as a low-pass filter, a by-pass filter or a band-illumination filter, or a multi-stage filter of three stages or more. Furthermore, in each of the above described embodiments, the edge angle of the resonator is made large, but the similar effect can also be obtained by using this structure in the main line such as the inductor composing the above described various kinds of filters.

Figure 12:
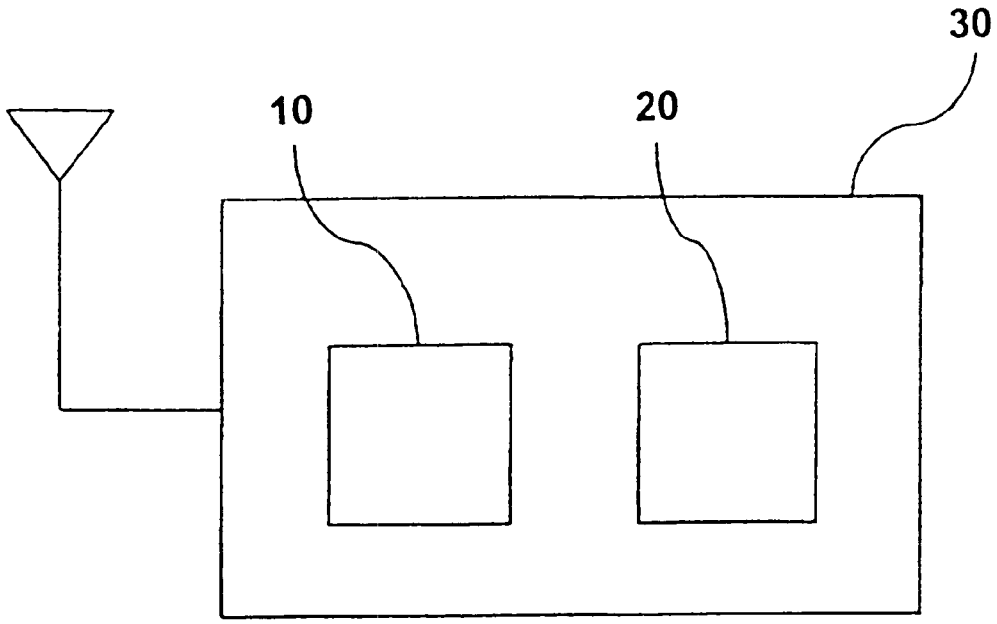
FIG. 12 is a schematic illustration showing communication equipment having a transmitter and a receiver.

Furthermore, as shown in FIG. 12, communication equipment 30 having a transmitter 10 and a receiver 20, and also including the dielectric laminated device according to the above described embodiments as an element, also is part of the present invention. The dielectric laminated device may be provided in the interior of the transmitter 10 or the receiver 20, or it may be provided separately and independently from the transmitter 10 and the receiver 20.

As mentioned above, the dielectric laminated device of the present invention has a large edge angle by thickening the side part of the strip line conductor, and it is possible to improve the conductor loss because of the concentration of the electric field to both end pointed parts. Furthermore, since only the pointed part is thick, it is possible to restrain the occurrence of a crack because of the difference in the heat expansion ratio between the dielectric and the conductor, and it is possible to prevent the degradation of the electric characteristics and the lowering of the mechanical strength. Furthermore, by increasing the thickness of the short-circuit end of the strip line conductor, the contact resistance with the external conductor can be decreased, and if the above described strip line conductor is used as a resonator, the loss as the filter characteristics can also be improved. Furthermore, if only the part near the short-circuit end of the above described strip line conductor is made thicker than other parts, the swell of the facing strip line conductors is small when forming the capacitor near the open end, and the design of the capacitance can be easily be performed.

What is claimed is:

1. A dielectric laminated device comprising:

a layered product including a plurality of dielectric layers; and a plurality of strip line conductors arranged in the interior of the layered product, wherein the thickness of at least part of the side part of at least one strip line conductor among said plurality of strip line conductors is thicker than that of the central part, said at least one strip line conductor forms a resonator of a quarter wavelength where one end is a short-circuit, and the thickness of the side part on the short-circuit end side of the resonator is thicker than that of the central part, and the thickness of at least a part of an open end of the resonator is thinner than that of the short circuit end.

2. The dielectric laminated device according to claim 1, wherein a plurality of shield conductors are arranged in the interior of said layered product, and at least two resonators of a quarter wavelength where the end is a short-circuit and a strip line conductor facing to part of said resonators of a quarter wavelength where the end is a short-circuit are arranged between said plurality of shield conductors, and the strip line conductor connects said two resonators of a quarter wavelength where the end is a short-circuit to each other and forms a multi-stage filter, and the thickness of part of said resonators of a quarter wavelength where the end is a-short circuit is thicker than that of the other part.

3. A dielectric laminated device comprising:

a layered product including a plurality of dielectric layers; and a plurality of strip line conductors arranged in the interior of the layered product, wherein the thickness of at least part of the side part of at least one strip line conductor among said plurality of strip line conductors is thicker than that of the central part, said at least one strip line conductor forms a resonator of a half wavelength where an end is an open circuit, and the thickness of the side part at a part substantially separated from the open end by a quarter wavelength in the wavelength direction of the resonator is thicker than that of the central part, and the thickness of at least part of the open end of the resonator is thinner than that of the part substantially separated from the open end by a quarter wavelength in the wavelength direction of the resonator.

4. A manufacturing method of a dielectric laminated device, having a layered product including a plurality of dielectric layers; and a plurality of strip line conductors arranged in the interior of the layered product, said method comprising:

a step of forming a resonator of a quarter wavelength where one end is a short-circuit, and where the thickness of the side part on the short-circuit end side of the resonator is thicker than that of the central part, and the thickness of at least a part of an open end of the resonator is thinner than that of the short circuit end.

5. A dielectric laminated device, comprising:

a layered product including a plurality of dielectric layers; and a plurality of strip line conductors arranged in the interior of the layered product, wherein the thickness of a part having more electric current concentrated is thicker than that of a part having less electric current concentrated, in at least one strip line conductor among said plurality of strip line conductors.

6. The dielectric laminated device according to claim 5, wherein said at least one strip line conductor forms a resonator of a quarter wavelength where one end is a short-circuit, and the thickness on the short-circuit end side of the resonator is thicker than that on an open end side.

7. The dielectric laminated device according to claim 5, wherein said at least one strip line conductor forms a resonator of a half wavelength where one end is an open circuit, and the thickness of a part substantially separated from the open end of the resonator by a quarter wavelength is thicker than that of the open end part.

8. Communication equipment, comprising:

a transmitter; and a receiver, wherein the dielectric laminated device according to any one of claims 1, 3, 5, 6, 7, 2 is included as an element.

9. The dielectric layered device according to any one of claims 1, 3, 5, 6, 7, wherein an inside material and an outside material of the strip line conductor are different at a part in which the thickness of said strip line conductor is relatively thick.

10. A manufacturing method of a dielectric laminated device, having a layered product including a plurality of dielectric layers; and a plurality of strip line conductors arranged in the interior of the layered product, said method comprising:

a step of forming a strip line conductor in which the thickness of a part having more electric current concentrated is thicker than that of a part having less electric current concentrated on a specific dielectric layer material, and a step pressing and laminating another dielectric layer material thereon.

11. A manufacturing method of a dielectric laminated device, having a layered product including a plurality of dielectric layers; and a plurality of strip line conductors arranged in the interior of the layered product, said method comprising:

a step of forming a resonator of a half wavelength where one end is an open circuit, and where the thickness of a side part at a part substantially separated from the open end by a quarter wavelength in the wavelength direction of the resonator is thicker than that of a central part, and the thickness of at least part of the open end of the resonator is thinner than that of the part substantially separated from the open end by a quarter wavelength in the wavelength direction of the resonator.

* * * * *